US008672653B2

(12) United States Patent
Mancini et al.

(10) Patent No.: US 8,672,653 B2
(45) Date of Patent: Mar. 18, 2014

(54) FUEL PUMP WITH AN IMPROVED DAMPING DEVICE FOR A DIRECT INJECTION SYSTEM

(75) Inventors: Luca Mancini, Budrio (IT); Daniele De Vita, Castel San Pietro (IT); Massimo Mattioli, Calderara di Reno (IT)

(73) Assignee: Magneti Marelli S.p.A., Corbetta (IT)

( * ) Notice: Subject to any disclaimer, the term of this patent is extended or adjusted under 35 U.S.C. 154(b) by 512 days.

(21) Appl. No.: 12/938,892

(22) Filed: Nov. 3, 2010

(65) Prior Publication Data

US 2011/0103985 A1 May 5, 2011

(30) Foreign Application Priority Data

Nov. 3, 2009 (IT) ..... BO2009A0720

(51) Int. Cl.
*F04B 15/00* (2006.01)
*F04B 19/22* (2006.01)
*F04B 53/00* (2006.01)

(52) U.S. Cl.
USPC ..... 417/540; 417/542; 123/447

(58) Field of Classification Search
USPC ..... 417/540, 542; 123/447; 138/26, 30
See application file for complete search history.

(56) References Cited

U.S. PATENT DOCUMENTS 7,124,738 B2 * 10/2006 Usui et al. ..... 123/446

* cited by examiner

*Primary Examiner* — Charles Freay
*Assistant Examiner* — Philip Stimpert
(74) *Attorney, Agent, or Firm* — Howard & Howard Attorneys PLLC

(57) ABSTRACT

A fuel pump for a direct injection system having: at least one pumping chamber; a piston which is mounted sliding inside the pumping chamber in order to vary cyclically the volume of the pumping chamber; an intake duct connected to the pumping chamber and regulated by an inlet valve; a delivery duct connected to the pumping chamber and regulated by a one-way delivery valve which allows exclusively a fuel flow outgoing from the pumping chamber; and a damping device, which is placed along the intake duct upstream of the inlet valve, and comprises at least one elastically deformable damping body that has internally a closed chamber filled with pressurized gas and composed of two metal plates cup shaped and welded together at their annular edges by an annular weld without interruptions.

7 Claims, 8 Drawing Sheets

FUEL PUMP WITH AN IMPROVED DAMPING DEVICE FOR A DIRECT INJECTION SYSTEM

CROSS-REFERENCE TO RELATED APPLICATION

This application claims priority under 35 U.S.C. §119 to Italian Patent Application No. B02009A-000720, filed on Nov. 3, 2009 with the Italian Patent and Trademark Office, the disclosure of which is incorporated herein in its entirety by reference.

TECHNICAL FIELD

The present invention relates to a fuel pump for a direct injection system.

PRIOR ART

A direct injection system comprises a plurality of injectors, a common rail which feeds pressurized fuel to the injectors, a high-pressure pump, which feeds the fuel to the common rail by means of a fuel inlet duct and is provided with a flow rate regulating device, and a control unit which drives the flow rate regulating device to maintain the fuel pressure within the common rail equal to a desired value generally variable over time according to the operating conditions of the engine.

The high-pressure pump comprises at least one pumping chamber, within which a piston runs with reciprocating motion, an intake duct regulated by an inlet valve for feeding low-pressure fuel into the pumping chamber and a delivery duct regulated by a delivery valve for feeding high-pressure fuel from the pumping chamber and to the common rail through the inlet duct. Generally, the flow rate regulating device acts on the inlet valve while maintaining the inlet valve itself open also during the step of pumping, so that a variable part of the fuel present in the pumping chamber goes back into the intake duct and is not pumped to the common rail through the inlet duct.

Patent application IT2009B000197 describes a high-pressure pump provided with a damping device which is arranged along the intake duct upstream of the inlet valve, is fixed to a body of the high-pressure pump and has the function of reducing the entity of the fuel flow rate pulsations, and thus the entity of the fuel pressure oscillations in the low-pressure branch. The fuel flow rate pulsations may produce noise at an audible frequency, which may be annoying for occupants of a vehicle which uses the fuel pump; furthermore, the fuel pressure oscillations may damage a low-pressure pump which draws the fuel from a tank for feeding the fuel itself to the high-pressure pump intake.

Patent EP1500811B1 describes a damping device for a fuel pump comprising one or two damping bodies, each of which has inside a closed chamber filled with pressurized gas and is composed of two cup-shaped metallic plates welded together at an annular edge. In each damping body, the respective annular edges of the plates are superimposed on one another and joined by means of an annular weld to constitute the annular edge of the damping body; the annular weld is made at the outer ends of the annular edges of the plates. For each damping body, the damping device described in patent EP1500811B1 comprises two fastening elements which pinch together the annular edge of the damping body over, under and inside the weld between the two metallic plates constituting the damping body itself. However, it has been observed that the mechanical structure of the damping device EP1500811B1 does not guarantee over time the tightness of the damping bodies which tend to be subject to a gradual loss of pressure of the gas contained in the closed chambers defined within the damper bodies themselves.

DESCRIPTION OF THE INVENTION

It is the object of the present invention to provide a fuel pump for a direct injection system, which fuel pump is free from the above-described drawbacks and which is easy and cost-effective to make.

According to the present invention, a fuel pump for a direct injection system is made as disclosed in the attached claims.

BRIEF DESCRIPTION OF THE DRAWINGS

The present invention will now be described with reference to the accompanying drawings, which set forth some non-limitative embodiments thereof, in which.

PREFERRED EMBODIMENTS OF THE INVENTION

Figure 1:
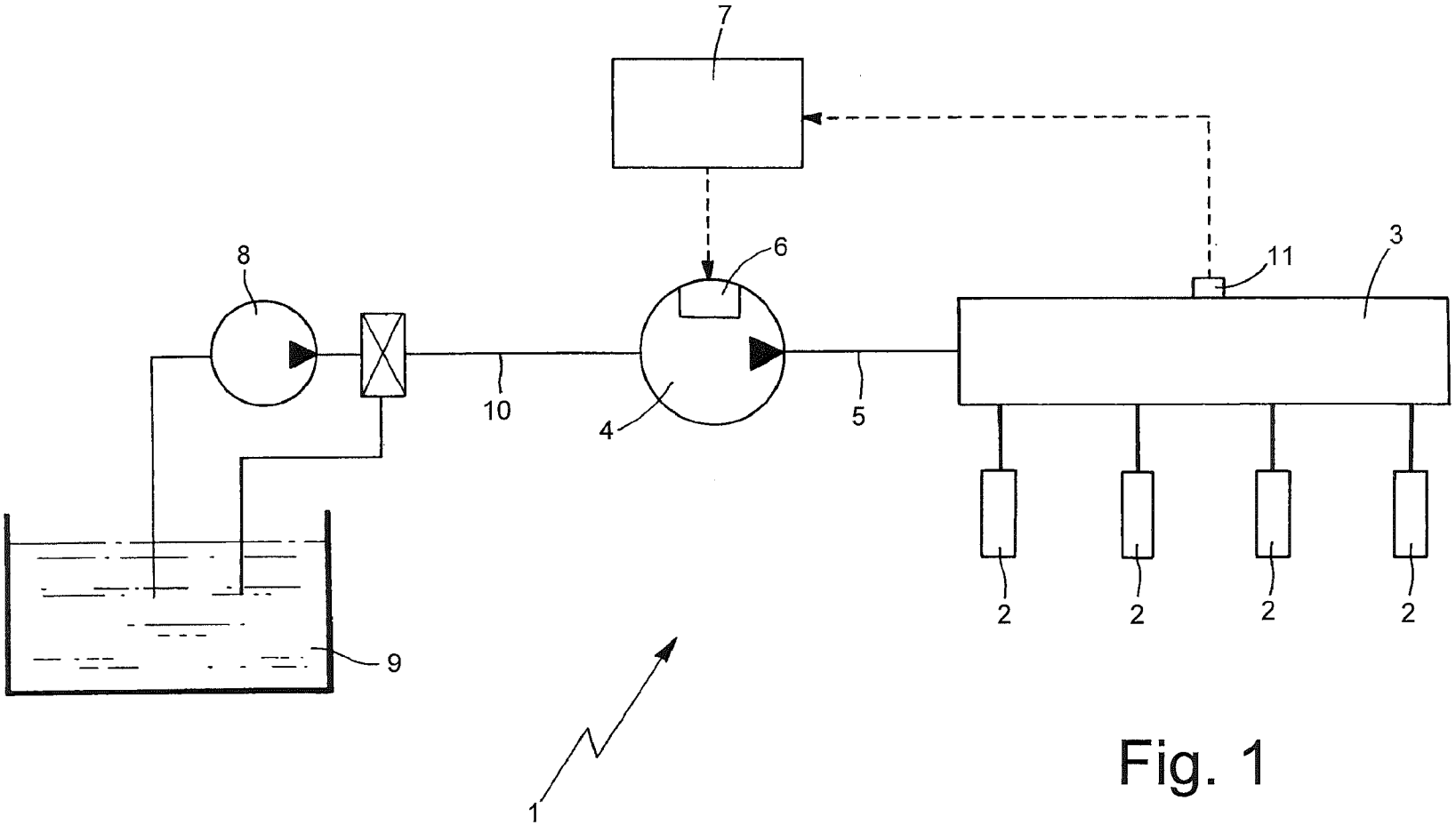
FIG. 1 is a diagrammatic view with parts removed for clarity of a direct fuel injection system of the common rail type.

In FIG. 1, numeral 1 indicates as a whole a direct fuel injection system of the common rail type for an internal combustion thermal engine.

The direct injection system 1 comprises a plurality of injectors 2, a common rail 3, which feeds pressurized fuel to the injectors 2, a high-pressure pump 4, which feeds the fuel to the common rail 3 by means of an inlet duct 5 and is provided with a flow rate regulating device, a control unit 7, which maintains the fuel pressure in the common rail 3 equal to a desired value generally variable over time according to the operating conditions of the engine and a low-pressure pump 8 which feeds the fuel from a tank 9 to the high-pressure pump 4 by means of an inlet duct 10.

The control unit 7 is coupled to the regulating device 6 to control the flow rate of the high-pressure pump 4 so as to feed to the common rail 3 the amount of fuel needed to have the desired fuel pressure in the common rail 3 itself instant-by-instant; in particular, the control unit 7 regulates the flow rate of the high-pressure pump 4 by means of a feedback control using the fuel pressure inside the common rail 3, which pressure value is detected in real time by a pressure sensor 11, as feedback variable.

Figure 2:
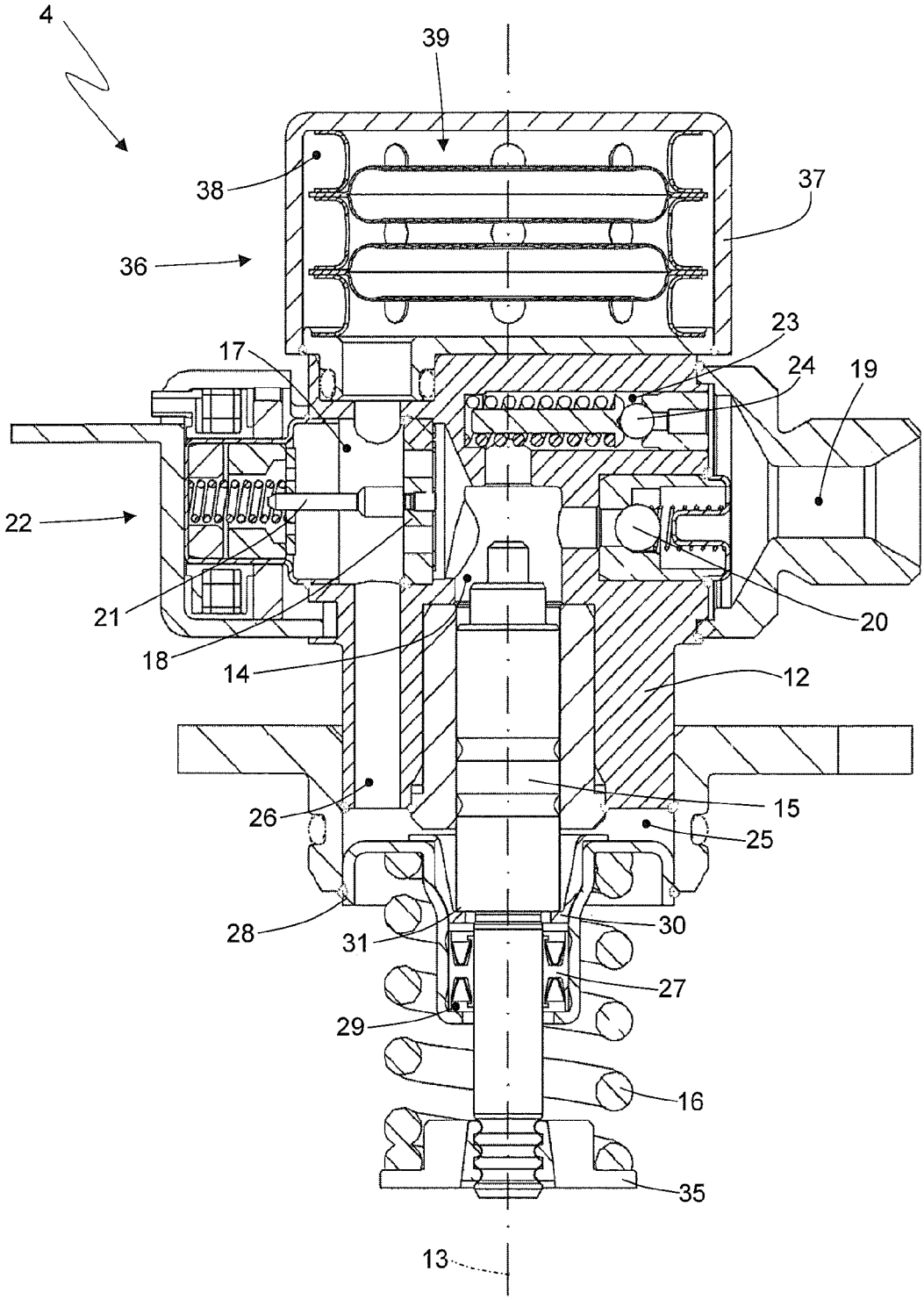
FIG. 2 is a diagrammatic, section view, with parts removed for clarity, of a high-pressure fuel pump of the direct injection system in FIG. 1.

As shown in FIG. 2, the high-pressure pump 4 comprises a main body 12, which has a longitudinal axis 13 and defines a pumping chamber 14 of cylindrical shape therein. A piston 15 is mounted sliding in the pumping chamber 14, which piston determines a cyclical variation of the volume of the pumping chamber 14 by moving with reciprocating motion along the longitudinal axis 13. A lower portion of the piston 15 is coupled on one side to a spring 16, which tends to push the piston 15 towards a maximum volume position of the pumping chamber 14 and on the other side is coupled to a cam (not shown), which is rotably fed by a driving shaft of the engine to cyclically move the piston 15 upwards, thus compressing the spring 16.

An intake duct 17, which is connected to the low-pressure pump 8 by means of the inlet duct 10 and is regulated by an inlet valve 18 arranged at the pumping chamber 14, originates from a side wall of the pumping chamber 14. The inlet valve 18 is normally pressure-controlled and in absence of external intervention the inlet valve 18 is closed when the fuel pressure in the pumping chamber 14 is higher than the fuel pressure in the intake duct 17 and is open when the fuel pressure in the pumping chamber 14 is lower than the fuel pressure in the intake duct 17.

A delivery duct 19, which is connected to the common rail 3 by means of the inlet duct 5 and is regulated by a one-way delivery valve 20, which is arranged at the pumping chamber 14 and exclusively allows a fuel flow outgoing from the pumping chamber 14, originates from a side wall of the pumping chamber 14 and from the opposite side with respect to the intake duct 17. The delivery valve 20 is pressure-controlled and open when the fuel pressure in the pumping chamber 14 is higher than the fuel pressure in the delivery duct 19 and is closed when the fuel pressure in the pumping chamber 14 is lower than the fuel pressure in the delivery duct 19.

The regulating device 6 is coupled to the inlet valve 18 to allow the control unit 7 to maintain the inlet valve 18 open during the step of pumping of the piston 15 and thus allow a fuel flow outgoing from the pumping chamber 14 through the intake duct 17. The regulating device 6 comprises a control rod 21, which is coupled to the inlet valve 18 and is mobile between a passive position, in which it allows the inlet valve 18 to close, and an active position, in which it does not allow the inlet valve 18 to close. The regulating device further comprises an electromagnetic actuator 22, which is coupled to the control rod 21 to move the control rod 21 between the active position and the passive position.

A discharge duct 23, which puts the pumping chamber 14 into communication with the delivery duct 19 and is regulated by a one-way maximum pressure, valve 24, which only exclusively allows a fuel flow ingoing to the pumping chamber 14, originates from an upper wall of the pumping chamber 14. The function of the maximum pressure valve 24 is to allow a release of fuel if the fuel pressure in the common rail 3 exceeds a maximum value predetermined in the step of designing (typically in case of errors in the control carried out by the control unit 7); in other words, the maximum pressure valve 24 is automatically calibrated when the pressure drop at its terminals is higher than a threshold value established during the step of designing, and thus prevents the fuel pressure in the common rail 3 from exceeding the maximum value established during the designing step.

A collection duct 25 is obtained in the main body 12, which collection duct is arranged underneath the pumping chamber 14 and is crossed by an intermediate portion of the piston 15, which is shaped so as to cyclically vary the volume of the collection duct 25 by effect of the reciprocating movement thereof. In particular, the intermediate portion of the piston 15 which is in the collection duct 25 is shaped as the upper portion of the piston 15, which is in the pumping chamber 14 so that when the piston 15 moves the volume variation in the collection chamber 25 by effect of the movement of the piston 15 is contrary to the volume variation which occurs in the pumping chamber 14 by effect of the movement of the piston 15. In ideal conditions, the volume variation which occurs in the collection duct 25 by effect of the movement of the piston 15 is equal to the volume variation which occurs in the pumping chamber 14 by effect of the movement of the piston 15, so as to obtain a perfect compensation between the two volume variations; in all cases, the ideal condition cannot always be obtained due to geometric and constructive constraints and thus the volume variation which occurs in the collection duct 25 by effect of the movement of the piston 15 may be smaller than the volume variation which occurs in the pumping chamber 14 by effect of the movement of the piston 15.

The collection chamber 25 is connected to the intake duct 17 by means of a connection duct 26 which flows into the inlet valve 18. Furthermore, an annular seal 25 is provided underneath the collection duct 27, which is arranged about a lower portion of the piston 15 and has the function of preventing leakages of fuel along the side wall of the piston 15. According to a preferred embodiment, the collection chamber 25 is superiorly and laterally delimited by a lower surface of the main body 12 and is inferiorly delimited by an annular plug 28, which is laterally welded to the main body 12. The annular plug 28 centrally has a cylinder-shaped seat 29, which accommodates the annular seal 27. The seat 29 is inferiorly and laterally delimited by corresponding walls of the annular plug 28 and is superiorly delimited by an annular element 30, which also defines an inferior limit stop of the piston 15; in particular, a shoulder 31 of the piston 15 rests on the annular element 30 preventing a further descent of the piston 15. It is worth noting that the lower limit stop of the stroke of the piston 15 constituted by the annular element 30 is only used during the transportation of the high-pressure pump 4 to prevent the "disassembly" of the piston 15; when the high-pressure pump 4 is mounted in an engine, the cam (not shown), which is coupled to the outer end of the piston 15, always maintains the shoulder 31 of the piston 15 raised with respect to the annular element 30 (in use, the possible impact of the shoulder 31 of the piston 15 against the annular element 30 could have a destructive effect).

Figure 7:
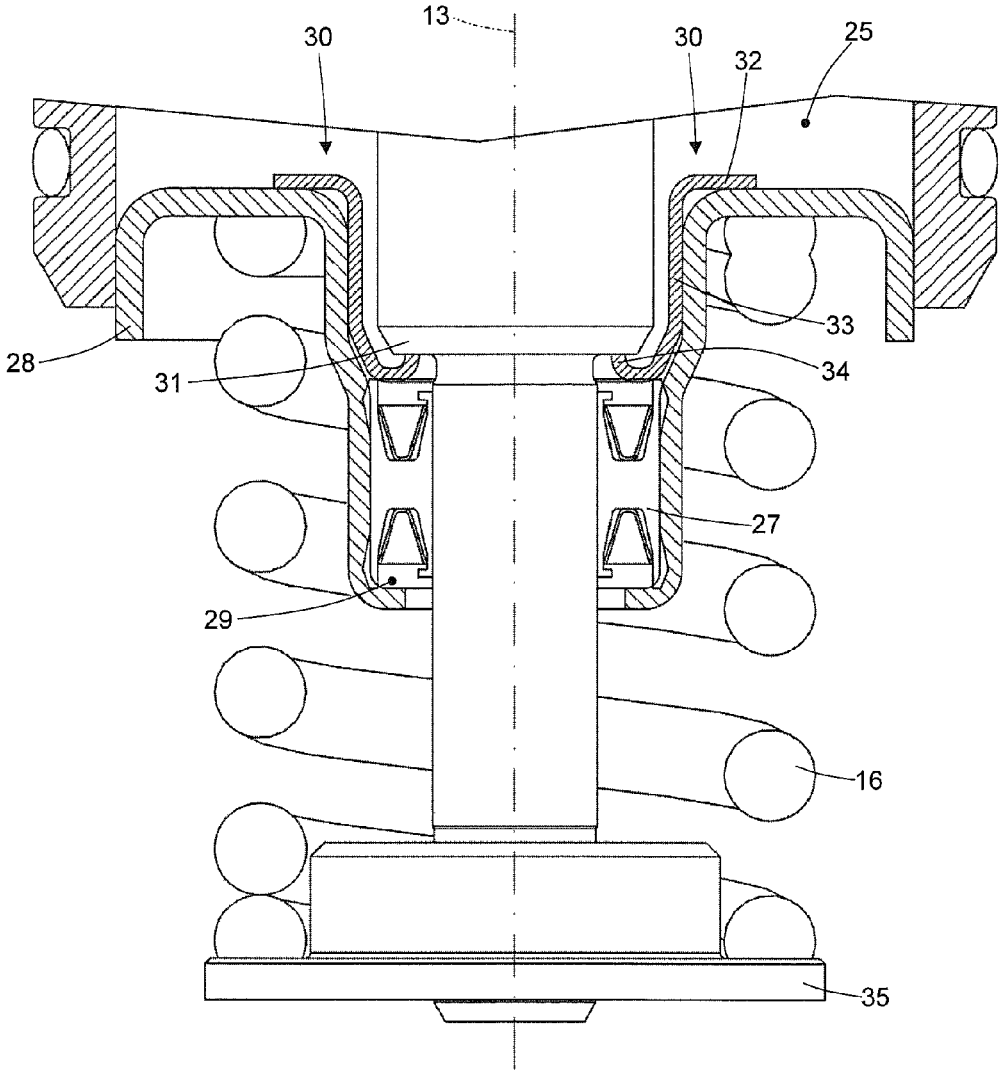
FIGS. 7 and 8 are two views on enlarged scale and in two different configurations of a different embodiment of an outer portion of a piston of the high-pressure fuel pump in FIG. 2.
Figure 8:
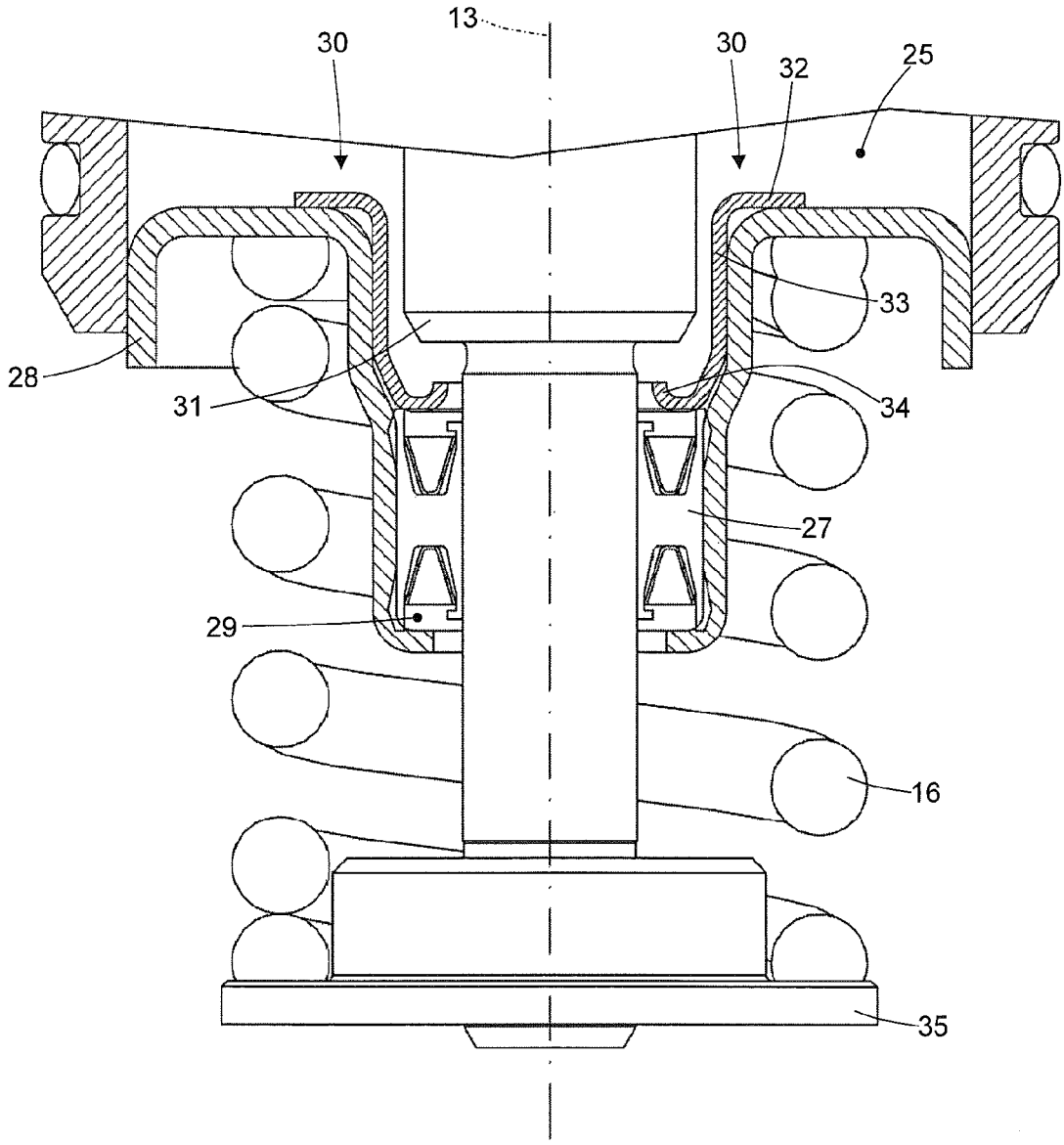

According to an embodiment illustrated in FIGS. 7 and 8, the annular element 30 in addition to having the above-described function of constituting a lower limit stop of the piston stroke 15 also has the function of axially containing the seal 27 so as to avoid possible axial movements of the seal 27 itself by effect of the cyclical axial movement of the piston 15. In other words, the axial dimension of the seat 29 which accommodates the seal 27 is substantially equal to (or—because the seal 27 is axially compressible—even slightly smaller than) the axial dimension of the seal 27 to prevent the seal 27 itself from "slacking" axially in the seat 29 by effect of the cyclical axial movement of the piston 15 (when the seal 27 "slacks" axially in the seat 29, the seal 27 itself is subjected to potentially destructive cyclic stress in relatively short times). Axially, the seat 29 is inferiorly delimited by a wall of the annular plug 28 and superiorly by the annular element 30; thus the position of the annular element 30 is established so that the axial dimension of the seat 29 is substantially equal to (or rather not higher than) the axial dimension of the seal 27.

According to an embodiment shown in FIGS. 7 and 8, the annular element 30 has an upper flat edge 32, which rests on an upper wall of the annular plug 28, a side edge 33, which rests on a side wall of the annular plug 28, and a lower edge 33, which protrudes from the side wall of the annular plug 28 and from one side constitutes the lower limit stop of the piston stroke 15 and from the opposite side constitutes an upper delimitation of the seat 29 which houses the seal 27. Preferably, the lower edge 33 has a "U"-shaped cross section so as to display some elastic deformability (i.e. may be axially deformed in elastic manner), which may be necessary to compensate possible constructive tolerances, and to absorb the impact of the shoulder 31 of the piston 15 with less stress. In order to increase the elastic deformability of the lower edge 33, the lower edge 33 itself is separated from the side wall of the annular plug 28, i.e. some gap is present between the lower edge 33 and the side wall of the annular plug 28. Preferably, the annular element 30 is fixed to the annular plug 28 by welding.

In particular, in FIG. 7 the piston 15 is in the lower limit position thereof, in which the shoulder 31 is in contact with the annular element 30, while in FIG. 8 the piston 15 is away from its lower limit position, and thus the shoulder 31 is at some distance from the annular element 30.

As shown in FIG. 2, the spring 23 is compressed between a lower wall of the annular plug 28 and an upper wall of an annular expansion 35 integral with the lower end of the piston 15; in this manner, the spring 23 is arranged outside the main body 12, and is thus both visually inspectable and completely isolated from the fuel.

In use, a first function of the collection duct 25 is to collect the fuel which inevitably leaks from the pumping chamber 14 along the side wall of the piston 15 during the step of pumping. Such fuel leakages reach the collection chamber 25 and thus from here are directed back towards the pumping chamber 14 through the connection duct 26. The presence of the annular seal 27 arranged under the collection chamber 25 prevents further fuel leakages along the side wall of the piston outside the collection chamber 25 itself. It is important to note that the fuel chamber 25 is low-pressure, and thus the annular seal 27 is not subjected to high stress.

In use, a further function of the collection chamber 25 is to contribute to compensating the fuel flow rate pulsations: when the piston 15 moves up thus reducing the volume of the pumping chamber 14, the fuel ejected by the pumping chamber 14 through the inlet valve 18, which is kept open by the regulating device 6, may flow towards the collection chamber 25 because the moving up of the piston 15 increases the volume of the collection chamber 25 (in the ideal condition by an amount equal to the corresponding volume reduction of the pumping chamber 14). When the piston 15 moves up thus reducing the volume of the pumping chamber 14 and the intake valve 18 is closed, the increase of volume of the collection chamber 25 determines a fuel intake in the collection chamber 25 of the intake chamber 17. When the piston 15 moves down, the volume of the pumping chamber 14 is increased and the volume of the collection chamber 25 is reduced (in the ideal condition by a same amount); in this situation, the fuel is ejected from the collection chamber 25 by effect of the decrease of volume in the collection chamber 25 itself by effect of the increase of volume of the pumping chamber 14 itself.

In other words, a fuel exchange cyclically occurs between the collection chamber 25 (which is filled when the piston 15 moves up during the step of pumping and is emptied when the piston 15 moves down during the step of intake) and the pumping chamber 14 (which is emptied when the piston 15 moves up during the step of pumping and is filled when the piston 15 moves down during the step of intake). In ideal conditions, such an exchange of fuel between the collection chamber 25 and the pumping chamber 14 is optimized when the movement of the piston 15 determines a volume variation in the collection chamber 25 equal and opposite to the volume variation in the pumping chamber 14; as previously mentioned, such as ideal condition cannot always be achieved due to the geometric and constrictive constraints, and it is thus possible that a volume variation which occurs in the collection chamber 25 by effect of the movement of the piston 15 is less with respect to the volume variation which occurs in the pumping chamber 14 by effect of the movement of the piston 15.

By virtue of the above-described cyclical fuel exchange between the collection chamber 25 and the pumping chamber 14, a very high reduction of the fuel pulsations of the fuel pulsations can be obtained in the inlet duct 10; some theoretic simulations have contemplated that the reduction of pulsations of the fuel in the inlet duct 10 may exceed 50% (i.e. the width of the pulsations is more than halved with respect to a similar high-pressure pump without the above-described cyclical fuel exchange).

The intake duct 17 connects the inlet duct 10 to the pumping chamber 14, is regulated by the intake valve 18 (arranged at the pumping chamber 14) and is developed mainly within the main body 12. A damping device 36 (compensator), which is fixed to the main body 12 of the high-pressure pump 4 and has the function of reducing the entity of the fuel flow rate pulsations, and thus the entity of the fuel pressure oscillations in the low-pressure branch (i.e. along the inlet duct 10), is arranged along the intake duct 17 (thus upstream of the inlet valve 18). The fuel flow rate pulsations may produce noise at an audible frequency which may be annoying for the occupants of a vehicle using the fuel pump; furthermore, the fuel pressure oscillations may damage the low-pressure pump 8.

The damping device 36 comprises a box 37 of cylindrical shape, inside which a damping chamber 38 is defined which houses two elastically deformable (or rather elastically compressible) damping bodies 39. The function of the damping bodies 39 is to attenuate the fluctuations (pulsations) of the fuel flow rate along the intake duct 10. The fuel intake inside the pumping chamber 14 is extremely discontinuous, i.e. has moments in which the fuel enters into the pumping chamber 14 (during the step of intake with the inlet valve 18 open), has moments in which the fuel does not enter or exit to/from the pumping chamber 14 (during the step of pumping of the inlet valve 18 closed), and has moments in which the fuel exits from the pumping chamber 14 (during the step of pumping with the inlet valve 18 open by effect of the action of the regulating device 6). Such discontinuities of fuel intake in the pumping chamber 14 are in part attenuated by the variation of volume in the damping bodies 39 and thus the fuel flow rate through the feeding pipe 10 may be continuous, i.e. less pulsing (i.e. the pulsations remain but have smaller width).

Figure 3:
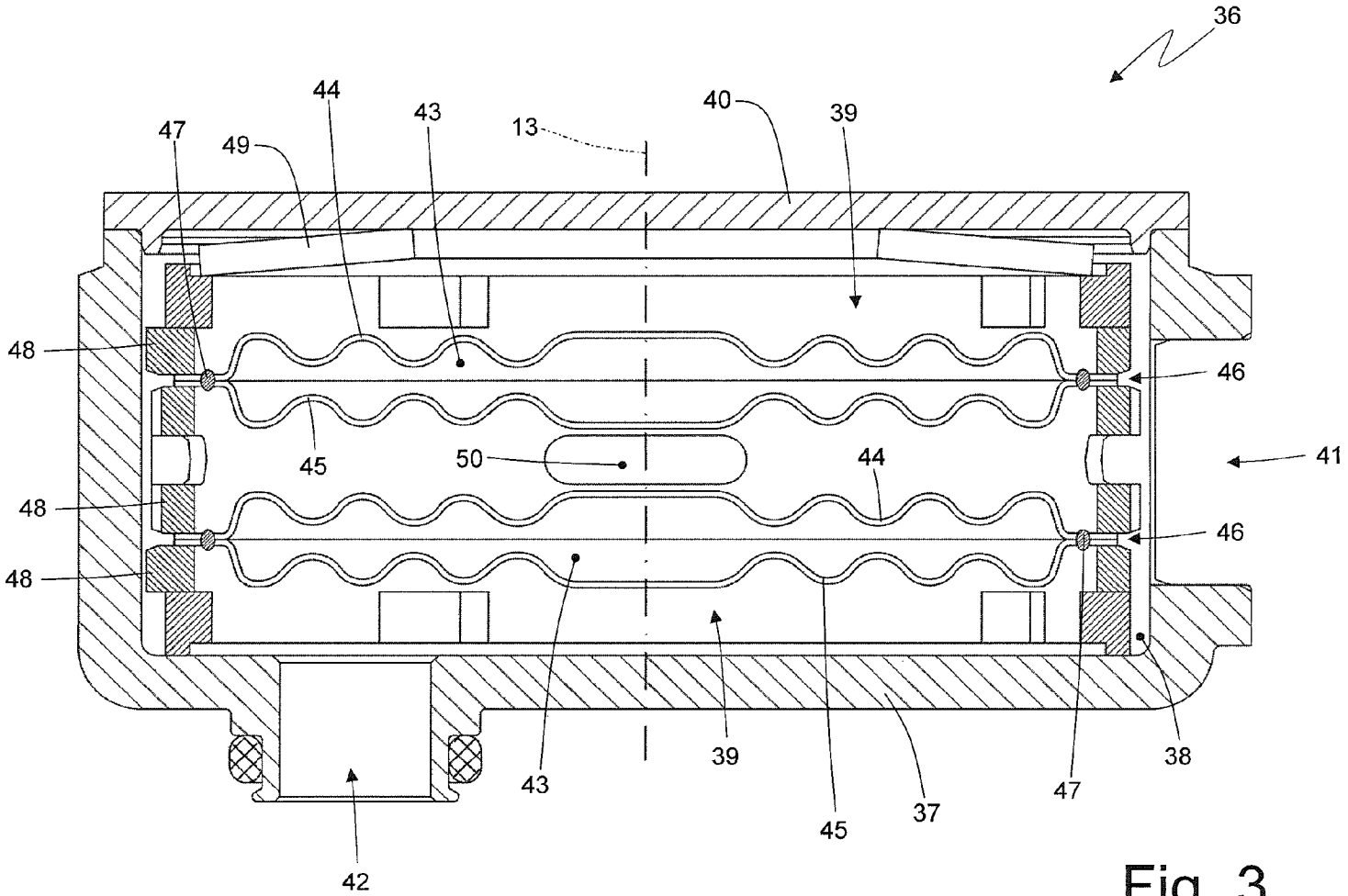
FIG. 3 is a view on enlarged scale of a different embodiment made according to the present invention of a damping device of the high-pressure pump in FIG. 2.

According to the embodiment shown in FIG. 3, the box 37 of the damping device 36 comprises an upper lid 40 which fluid-tightly closes the damping chamber 38; furthermore, the box 37 has a side input opening 41 connected to the intake duct 10 and a lower output opening 42 which gives into the intake duct 17.

Each damping body 39 internally has a closed chamber 43 filled with pressurized gas and composed of two metallic plates 44 and 45, cup-shaped and welded together at an annular edge 46 by means of an annular weld 47 without interruptions (i.e. the annular weld 47 extends for 360° forming a closed circumference at the annular edge 46).

The damping bodies 39 are supported in the damping chamber 38 by annular supporting elements 48 which pinch the external edges 46 of the damping bodies 39 outside the annular welds 47. In other words, the annular edge 47 of each damping body 39 is pinched above and below by two supporting element 48 arranged outside the annular weld 47. In particular, three supporting elements 48 are present: two external or side supporting elements 48, each of which withhold one only damping body 39, and an inner or central supporting element 48, which withholds both damping bodies 39 and is arranged between the two damping bodies 39 themselves.

The set of the three supporting elements 48 is pressed pack inside the box 37 by the pushing action of the lid 40 which is transmitted by means of a cup-shaped spring 49 interposed between the lid 40 and the set of the three supporting elements 48; the function of the cup spring 49 interposed between the lid 40 and the set of the three supporting elements 48 is to compensate the constructive tolerance and to maintain the three supporting elements 48 pack pressed with a predetermined force. According to a different embodiment (not shown), the cup spring 49 is not present and its function is carried out by the supporting elements 48 which axially has some degree of elastic compressibility; in other words, the supporting elements 48 are axially elastic so as to be elastically deformed in axial direction when they are compressed by the lid 40.

According to preferred embodiment, each supporting element 48 has a series of through holes 50 obtained through a cylindrical side wall which allows the fuel flow through the supporting element 48 itself.

Figure 4:
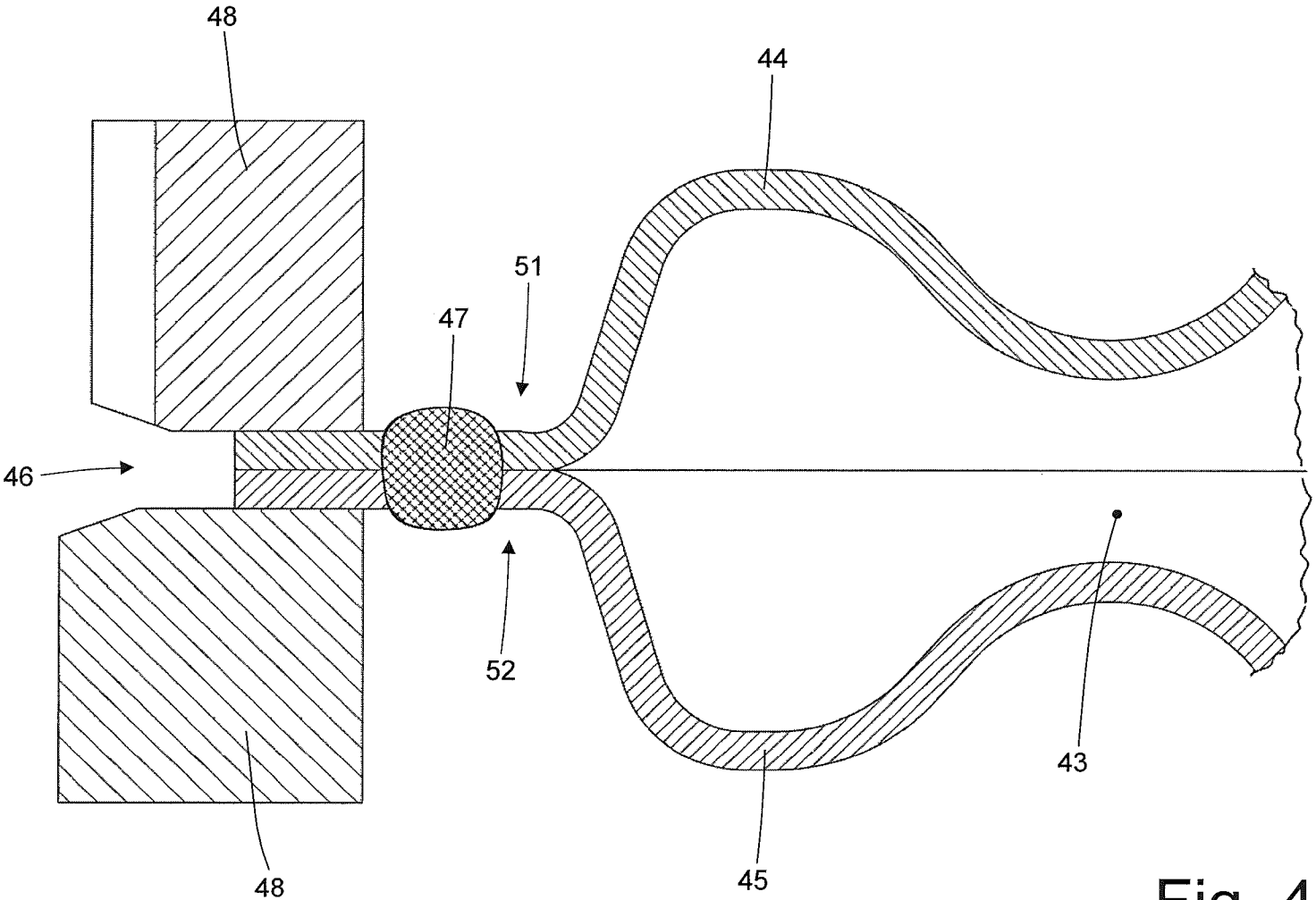
FIG. 4 is an enlarged scale view of a detail of the damping device in FIG. 3.

As shown in FIG. 4, in each damping body 39, the plates 44 and 45 have respective annular edges 51 and 52 which are superimposed on one another and joined by means of the annular weld 47 for constituting the annular edge 46 of the damping body 39. It is important to note that in each damping body 39 the annular weld 47 is made in an intermediate area of the annular edges 51 and 52 of the plates 44 and 45 so as to be at some distance from the outer ends of the annular edges 51 and 52 themselves. In other words, the annular weld 47 is arranged in an intermediate position between the outer ends of the annular edges 51 and 52 of the plates 44 and and the closed chamber 43 and according to constructive variants may be arranged either a little closer to the outer ends of the annular edges 51 and 52 or a little closer to the closed chamber 43.

Figure 5:
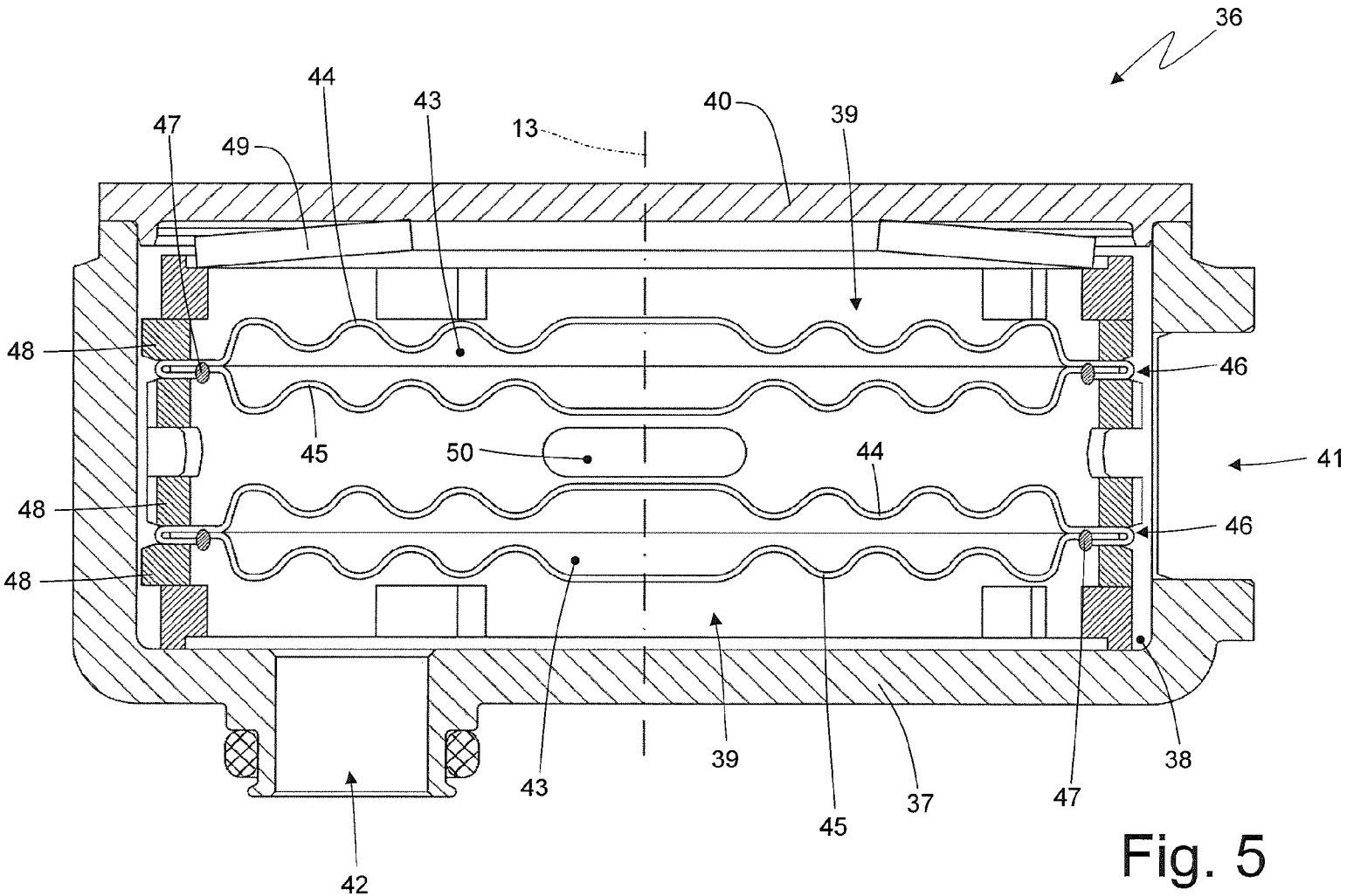
FIG. 5 is an enlarged scale view of a variant of the damping device in FIG. 3.
Figure 6:
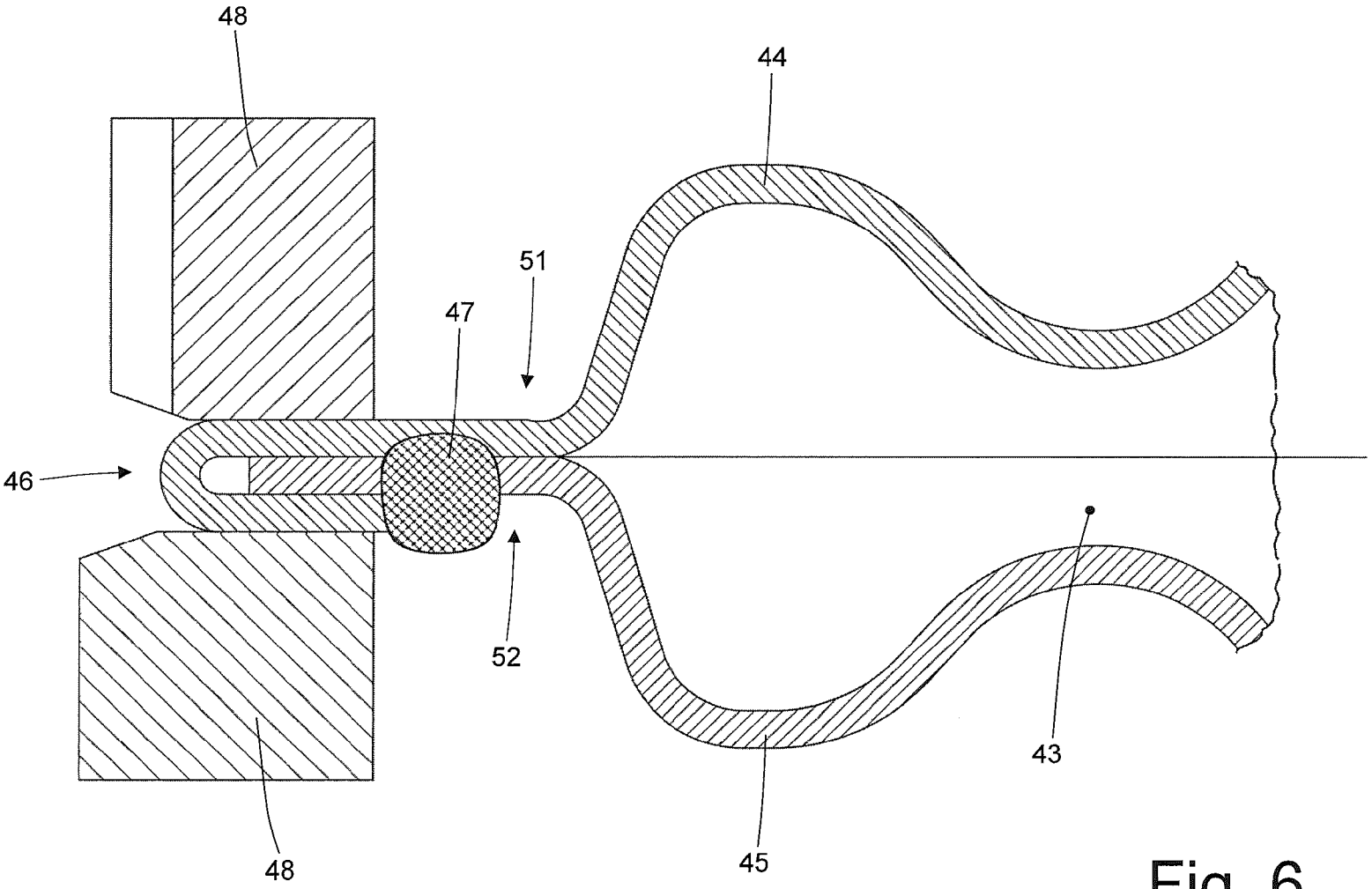
FIG. 6 is an enlarged scale view of a detail of the damping device in FIG. 5.

In the embodiment shown in FIGS. 3 and 4, the annular edges 51 and 52 of the two plates 44 and 45 have the same shape and size, and thus define a mirror structure at the annular edge 46 of the damping body 39, in which the inner surface of the edge 51 is in contact with an inner surface of the edge 52. In the embodiment shown in FIGS. 5 and 6, the annular edges 51 and 52 of the two plates 44 and 45 have differentiated shape and size: the annular edge 51 of the plate 44 is more extended than the annular edge 52 of the plate 45 and is bent into a "U" shape to embrace (surround) on both sides the annular edge of the plate 45; in other words, the annular edge 52 of the plate 45 is flat, while the annular edge 51 of the plate 44 is "U"-shaped to embrace the annular edge 52 of the plate 45 from both sides. In this embodiment, the annular weld 47 may be double to joint, the annular edge 51 of the plate 44 from both sides of the annular edge 52 of the blade 45 (as clearly shown in FIG. 6), or may be unique to join the annular edge 51 of the plate 44 to a single side of the annular edge 52 of the plate 45 (variant not shown).

The above-described damping device 36 has the advantage of guaranteeing the fluid-tightness of the damping bodies 39, which are not subject to a gradual loss of gas pressure contained in the closed chambers 53 defined within the damping bodies 39 themselves, over time. Such a result is obtained by virtue of the fact that for each damping body 39 the annular weld 47 is not made at the outer ends of the annular edges 51 and 52 of the blades 44 and 45, but is made in an intermediate area of the annular edges 51 and 52 of the plates 44 and (i.e. at some distance from the outer ends of the annular edges 51 and 52); indeed, by virtue of this positioning of the annular weld 47 the annular weld 47 itself has a higher mechanical strength and a lower likelihood of displaying through-cracks.

The invention claimed is:

1. A fuel pump for a direct injection system comprising:

at least one pumping chamber;

a piston which is mounted sliding inside the pumping chamber in order to vary cyclically the volume of the pumping chamber;

an intake duct connected to the pumping chamber and regulated by an inlet valve;

a delivery duct connected to the pumping chamber and regulated by a one-way delivery valve which allows exclusively a fuel flow outgoing from the pumping chamber; and a damping device, which is placed along the intake duct upstream of the inlet valve, and comprises at least one elastically deformable damping body that has internally a closed chamber and is composed of two metal plates cup shaped and welded together in correspondence of their annular edges by an annular weld without interruptions;

wherein in the damping body the annular weld is created in a middle area of the annular edges of the plates so as to be at some distance from the outer ends of the annular edges themselves; and wherein the annular edges of the plates have different shapes and sizes; a first annular edge of a first plate is larger than a second annular edge of a second plate and is bent into a "U" shape to embrace on both sides the second annular edge of the second plate.

2. A fuel pump according to claim 1, wherein the damping device comprises a box of cylindrical shape, inside which a damping chamber is defined which houses the damping body.

3. A fuel pump according to claim 2, wherein the box has a side input opening that can be connected to a inlet fuel duct and an lower output opening which flows into the intake duct.

4. A fuel pump according to claim 2, wherein the damping device comprises two annular support elements which pinch together the external edges of the damping body on the outside of the annular welds.

5. A fuel pump according to claim 4, wherein the set of the support elements is pressed pack inside the box by the pushing action of a lid of the box, the pushing actions is transmitted through a cup spring interposed between the lid and the set of the support elements.

6. A fuel pump according to claim 4, wherein at least one support element has an axially elastic compressibility and the set of the support elements is pressed pack inside the box by the pushing action of a lid of the box.

7. A fuel pump according to claim 4, wherein the support element has a number of through holes made through a cylindrical side wall to allow the flow of fuel through the support element.

* * * * *